US007178281B2

(12) United States Patent
Johansson et al.

(10) Patent No.: US 7,178,281 B2
(45) Date of Patent: Feb. 20, 2007

(54) FABRIC SIGN

(76) Inventors: Göran Johansson, Måns Smeds Vag 12, Kil (SE) SE-665 34; Patrik Johansson, Norra Karhlsholmsgatan 13, Karlstad (SE) SE-653 42

( * ) Notice: Subject to any disclaimer, the term of this patent is extended or adjusted under 35 U.S.C. 154(b) by 415 days.

(21) Appl. No.: 10/491,617

(22) PCT Filed: Sep. 19, 2002

(86) PCT No.: PCT/SE02/01692

§ 371 (c)(1),
(2), (4) Date: Apr. 2, 2004

(87) PCT Pub. No.: WO03/030133

PCT Pub. Date: Apr. 10, 2003

(65) Prior Publication Data

US 2004/0237365 A1 Dec. 2, 2004

(30) Foreign Application Priority Data

Oct. 4, 2001 (SE) ..... 0103319

(51) Int. Cl.
*G09F 17/00* (2006.01)

(52) U.S. Cl. ..... 40/603; 40/590; 38/102.91

(58) Field of Classification Search ..... 40/603, 40/792, 793, 795, 796, 590; 38/102, 102.91
See application file for complete search history.

(56) References Cited

U.S. PATENT DOCUMENTS 4,265,039 A 5/1981 Brooks (Continued)

FOREIGN PATENT DOCUMENTS

EP 0 114 453 8/1984

(Continued)

*Primary Examiner*—Gary C. Hoge
(74) *Attorney, Agent, or Firm*—Nixon & Vanderhye P.C.

(57) ABSTRACT

A fabric sign having a pair of parallel support elements (1, 2) and a fabric (3) with two parallel edge portions (4, 5) for assembly on one each of the support elements, at least one of the support elements comprising a frame profile (7) with a counter support (12) having an inner wall section (17) forming a continuation of said attachment part (14), an outer, flange-like wall section (19) with a free supporting end (20) to form a pivot (A), and an end wall section (18) connecting the inner and outer wall sections with each other, said wall sections defining between them a clamping pocket (25), and a clamping profile (8) for clamping the fabric to the frame profile, which clamping profile has a pressure part (28) for manual actuation, retaining devices (48, 49) for retaining the edge portion of the fabric, and an engagement part (27) arranged to cooperate with the inner and outer wall sections of the counter support when the pressure part is pressed against the attachment part while the clamping profile is turned about said pivot, at the same time creating tensile stress in the fabric. In accordance with the invention the outer wall section of the counter support has an extension that allows the clamping profile to exceed an equilibrium, at which exceeding of the equilibrium the tensile stress acts to move the clamping profile to a locked position in which the clamping profile is in locked engagement with the frame profile, said locked position being maintained by the tensile stress.

11 Claims, 3 Drawing Sheets

U.S. PATENT DOCUMENTS

| | | | | |
|---|---|---|---|---|
| 5,398,388 | A | 3/1995 | Coleman | |
| 5,893,227 | A | 4/1999 | Johansson et al. | |
| 6,250,002 | B1 * | 6/2001 | Wittenberg | 40/603 |
| 6,305,111 | B1 * | 10/2001 | Opdahl | 40/603 |
| 6,530,165 | B2 * | 3/2003 | Griesemer et al. | 40/603 |
| 6,862,825 | B1 * | 3/2005 | Lowndes | 40/603 |
| 2002/0029504 | A1 * | 3/2002 | Lowndes | 40/603 |

FOREIGN PATENT DOCUMENTS

| | | |
|---|---|---|
| EP | 0 495 688 | 7/1992 |
| EP | 0 503 705 | 9/1992 |
| EP | 0 778 973 | 3/2000 |

* cited by examiner

FABRIC SIGN

This application is the United States national phase of International PCT Application No. PCT/SE02/01692, filed Sep. 19, 2002, which designated the United States PCT/SE02/01692 claims priority of Sweedish Patent Application No. 0103319—0 filed Oct. 4, 2001.

The present invention relates to a fabric sign comprising at least one pair of parallel support elements for attachment to a base and a fabric comprising two parallel edge portions for assembly on one each of the support elements, at least one of the support elements comprising

- a frame profile that includes,
  - an attachment part for said attachment to the base, and
  - a counter support part that includes
    - an inner wall section forming a continuation of said attachment part,
    - an outer, flange-like wall section with a free supporting end (20) to form a pivot, and
    - an end wall section connecting the inner and outer wall sections, said wall sections defining between them a clamping pocket, and
- a clamping profile for clamping the fabric to the frame profile, which clamping profile comprises
  - a pressure part for manual actuation,
  - retaining devices for retaining the edge portion of the fabric, and
  - an engagement part arranged to cooperate with the inner and outer wall sections of the counter support part when the pressure part is pressed against the attachment part while the clamping profile is turned about said pivot, at the same time creating tensile stress in the fabric.

The term "profile" here refers to an elongate, continuous and stable structural element which has the same cross-sectional shape in all parallel cross sections between its ends. The length of each profile corresponds to the length or height, respectively, of the fabric sign. The profiles are generally manufactured by means of extrusion. However, they may also be manufactured by bending a rigid sheet billet.

EP-B1-0 778 973 describes a fabric sign of the above-mentioned type in which the frame profile has a bent edge part which is arranged to form a counter support for one edge part of the clamping profile upon turning in order to stretch the fabric. In an embodiment described the clamping profile is secured in its tensioned position on the frame profile with the aid of screws or similar attachment means. However, this arrangement always entails relatively long assembly times and is therefore expensive. In another embodiment described the clamping profile is provided with a locking flange with a free end. The free end is in the shape of an outwardly directed bead arranged to be brought into locking engagement with a corresponding locking flange on the frame profile. A similar locking arrangement is described in EP-A-0 495 688. In this case the clamping profile has a protruding locking bar which is arranged to be brought into locking engagement with an opening in the frame profile by means of "snap action". However, in such an arrangement the tensile stress in the fabric acts to release the locking bar from the opening. The continuously acting releasing tendency thus causes a risk of undesired loosening of the clamping profile from the frame profile.

The American patent U.S. Pat. No. 4,265,039 describes another fabric sign of the type mentioned above. Each support element includes a plurality of short clamping profiles and a frame profile. Each clamping profile is provided with a clamping pocket in which the edge portion of the fabric is anchored. The frame profile has a curved edge part which, when turning is effected to tension the fabric, is arranged to form a counter support for one edge part of each clamping profile. A locking profile is arranged at each clamping profile to lock the clamping profile to the frame profile. It will be understood that this locking is extremely complicated and time-consuming to perform. The many parts make this fabric sign expensive to produce and it will also be understood that the tensioning force will be unevenly distributed along the fabric since it is clamped pointwise and not continuously. The fabric will thus exhibit folds or wavy portions.

It may be stated that fabric signs have been known for several decades but have only recently been used more generally following improvements in both the fabric material and the assembly systems for tensioning the fabric. The known assembly systems are still relatively complicated and this is reflected in the cost of a finished fabric sign. Furthermore, specially trained people are usually required to change the fabric in a conventional fabric sign. However, nowadays there is a need for changing the fabric at frequent intervals. This may for example apply to haulage firms who rent out advertising space on the sides of their trucks. It is then desirable that the construction of the fabric signs enables the truck driver to quickly and simply change the fabric himself without specially trained people having to be called in and without the reliability of the fabric signs as regards assembly being jeopardized.

The purpose of the present invention is to provide a fabric sign that enables simple, reliable and self-locking tensioning of the fabric, as well as low manufacturing and assembly costs.

The fabric sign in accordance with the present invention is characterized in that the outer wall section of the counter support part has a predetermined minimum extension, seen in a cross section of the frame profile, that allows the clamping profile to exceed an equilibrium defined by a predetermined angle between the frame and clamping profiles, at which exceeding of the equilibrium the tensile stress acts to move the clamping profile to a locked position in which the clamping profile is in locked engagement with the frame profile, said locked position being maintained by the tensile stress.

The invention will be described in more detail with reference to the drawings.

Figure 1:
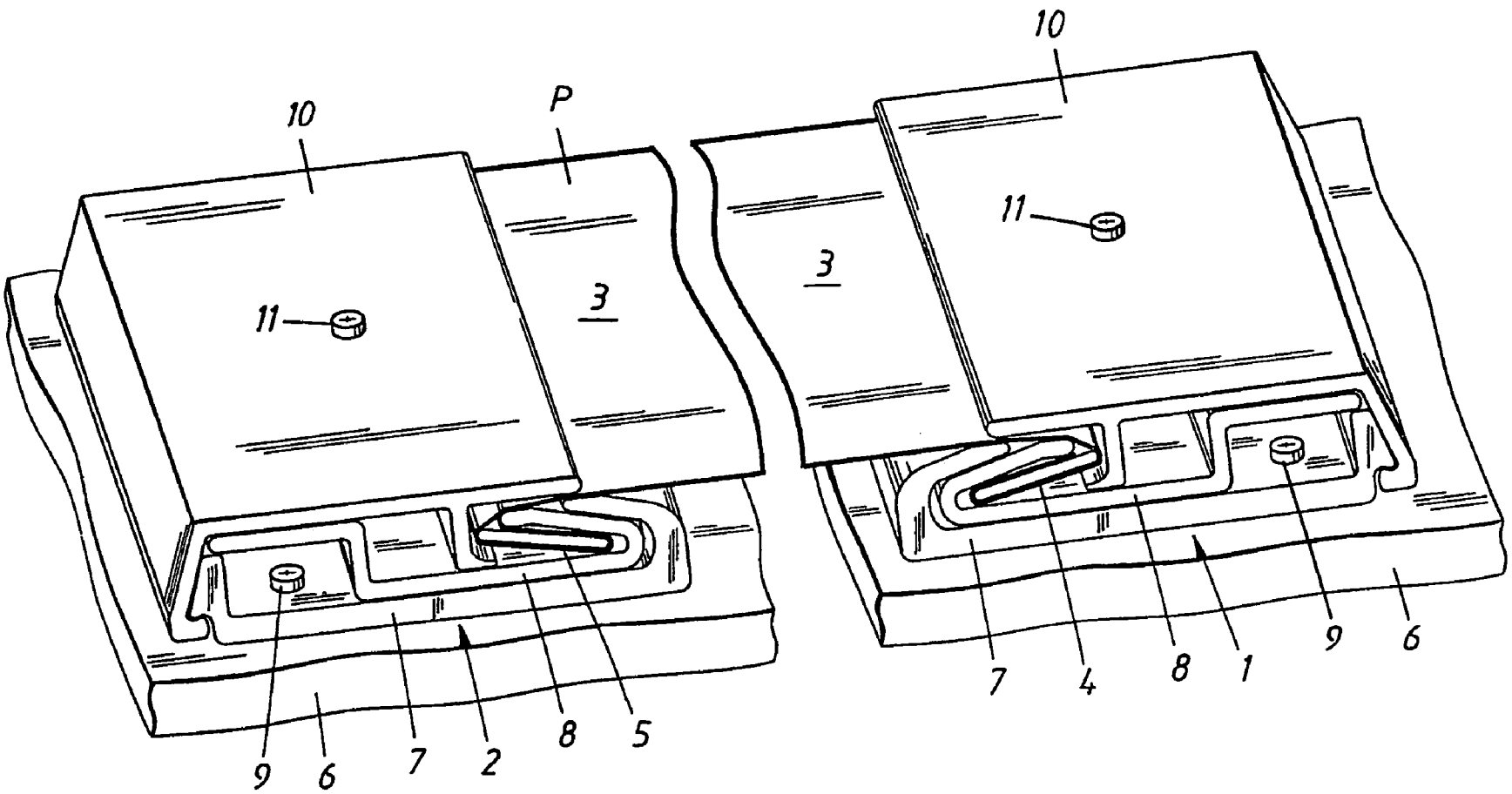
FIG. 1 is a perspective view of a cut out part of a fabric sign in accordance with a first embodiment of the invention.

With reference to FIG. 1 it shows a cut out part of a fabric sign having a pair of opposing parallel, elongate first and second support elements 1, 2 and a fabric 3 extending in a plane P between the two support elements 1, 2. The fabric 3 has two parallel edge portions 4, 5 by means of which the fabric 3 is tautly mounted between the support elements 1, 2. The two support elements 1, 2 may be connected at their ends to a second pair of parallel support elements (not shown) so that a uniform frame is formed. Alternatively the fabric 3 may be clamped between only two parallel support elements. The support elements 1, 2 are mounted on a base 6 which may be the stand of the fabric sign or a part thereof. Alternatively the base 6 maybe a house facade, a container wall, the side of a truck or some other surface on which the fabric sign is mounted. At least one of the support elements in each pair comprises a frame profile 7 and a clamping profile 8. The frame profile 7 is secured to the base 6 by screws 9. The clamping profile 8 is inserted in the frame profile 7 and the fabric 3 is in turn anchored in the clamping profile 8. A locking profile 10 is fitted on each support element 1, 2 to hide the attachment of the fabric 3 in the support elements 1, 2. In FIG. 1 the locking profiles 10 are secured to the support elements 1, 2 with the aid of attachment means in the form of screws 11.

In the following the frame and clamping profiles 7, 8 will be described in more detail with reference to FIG. 2 which, in an end view, shows the support element 1 during assembly, i.e. tensioning of the fabric 3. The frame profile 7 comprises an inner edge part 12 facing the opposing support element, not shown in FIG. 2, an outer edge part 13 facing away from the opposing support element, and a mid-section 14 joining the edge parts 12, 13 together. The mid-section 14 is straight and has flat internal and external surfaces 15, 16. The external, lower surface 16 of the mid-section 14 is arranged to abut the base and is attached thereto by means of said screws 9 (see FIG. 1). The mid-section 14 thus forms an attachment part of the frame profile 7. The inner edge part 12 comprises an inner wall section 17 forming a continuation of said attachment part 14, an end wall section 18 bending up from the inner wall section 17 and back in the direction of the outer edge part 13, and also an outer, flange-like wall section 19 with a free supporting end 20. The end wall part 18 has a concave internal surface 21 and the support end 20 has a convex support surface 22. The wall sections 17 and 19 have flat internal surfaces 23 and 24, respectively. Between them said wall sections 17, 18 and 19 define a clamping pocket 25 that opens towards the outer edge part 13. More specifically the clamping pocket 25 is defined by the surface 21 forming the bottom of the pocket 25 and the opposing, flat surfaces 23 and 24 which converge towards the bottom 21 of the pocket 25. The outer edge part 13 protrudes substantially perpendicularly from the attachment part 14. The edge part 13 is provided with a heel 26 for engagement with said locking profile 10, as can be seen in FIG. 1.

Like the frame profile 7 the clamping profile 8 comprises an inner edge part 27, an outer edge part 28 and a mid-section 29 joining the edge parts 27 and 28. The mid-section 29 is straight and its internal and external surfaces 30, 31 are flat. The outer edge part 28 of the clamping profile 8 is angled, having a first straight wall section 32 protruding substantially perpendicularly from the mid-section 29 of the clamping profile 8, a second straight wall section 33 adjoining the wall section 32 and extending parallel to the mid-section 29 of the clamping profile 8 in a direction away from the inner edge part 27. The inner edge part 27 is bent and comprises an inner, straight wall section 34 which forms a continuation of the mid-section 29, a bent end wall 35 which forms a continuation of the inner wall section 34 and then bends back towards the outer edge section 28, an outer wall section 36 substantially parallel to the inner wall section 34 which forms a continuation of the end wall section 35, and terminates in a free end 38. The end wall section 35 has a convex external end surface 39 and a concave internal surface 40. The inner wall section 34 has flat external and internal surfaces 41, 42 forming extensions of the external and internal surfaces 31, 30 of the mid-section 29. The outer wall section 36 has external and internal surfaces 43, 44 which are substantially flat and form angles with the flat surfaces 41, 42 of the inner wall section 34 but which are bent at the free end 38 to run substantially parallel to the surfaces 41 and 42. The free end 38 has a convex end surface 47. The wall sections 34–36 define between them an assembly pocket 48 that opens towards the outer edge part 28. More specifically the assembly pocket 48 is defined by the surface 40 forming the bottom of the pocket 25 and the internal, opposing surfaces 42 and 44 which converge towards the bottom 40 of the assembly pocket 48.

The inner edge part 12 of the frame profile 7 is arranged to form a counter support part and the inner edge part 27 of the clamping profile 8 an engagement part, which counter support and engagement parts are arranged to cooperate with each other upon assembly of the fabric 3. The fabric 3 is intended to be clamped to the clamping profile 8 by means of an elongate bar 49 around which one edge portion 4 of the fabric 3 is intended to be folded prior to assembly, as can be seen in FIG. 2. Upon assembly the bar 49 with the edge portion 4 of the fabric wound around it is inserted into the assembly pocket 48 of the clamping profile 8 so that the bar 49 with the edge portion 4 of the fabric comes into contact with the internal surfaces 42, 44 of the pocket 48. Thereafter the clamping profile 8 is inserted at an angle to the frame profile 7 so that the inner edge part 27 of the clamping profile 8 is brought into contact with the support end 20 and the inner wall section 17 of the inner edge part 12 of the frame profile 7. The frame and clamping profiles 7, 8 are thus brought into contact with each other along a first contact line A where the external surface 43 of the outer wall section 36 of the clamping profile 8 abuts the support surface 22 of the support end 20 of the frame profile 7, and also a second contact line B where the external end surface 39 of the end wall section 35 of the clamping profile 8 abuts the internal surface 23 of the inner wall section 17 of the frame profile 7. These contact lines A, B extend in the common longitudinal direction of the profiles 7, 8. The outer edge part 28 of the clamping profile 8 is then pressed with manual pressure down towards the outer edge part 13 of the frame profile 7 in a fabric-tensioning turning movement about the support end 20, thereby producing increasing tensile stress in the fabric 3. The contact line A thus forms a centre of rotation about which the clamping profile 8 is turned. The mid-section 29 of the clamping profile 8 thus forms a lever and the outer end section 28 a manually actuatable pressure part with the aid of which the tensile stress in the fabric 3 is overcome. When the clamping profile 8 is pressed down towards the frame profile 7 the clamping profile 8 is turned clockwise in the clamping pocket 25. The contact line A is thus displaced along the support surface 22 on the frame profile 7, and the contact line B is displaced along the internal surface 23 towards the bottom 21 of the clamping pocket 25. On the clamping profile 8 the contact line A is moved along the external surface 43 away from the end wall section 35, and the contact line B is moved counter-clockwise along the end surface 39 of the end wall section 35. The width of the bar 49 is such that, when inserted in the assembly pocket 48, it has an edge part 50 protruding from the assembly pocket 48. When the tensile stress becomes effective in the fabric 3 the bar 49 will be pressed into the assembly pocket 48, whereupon the bar 49 clamps the edge portion 4 of the fabric firmly between itself and the internal surfaces 42, 44 of the assembly pocket 48. A self-locking effect is thus obtained and this effect increases in proportion to increasing tensile stress in the fabric 3. The assembly pocket 48 and bar 49 thus form a retaining device for the fabric 3. It is assumed here that the opposite edge portion of the fabric 3, not shown in FIG. 2, has already been secured to the opposite support element, not shown, which may be the same shape as the support element 1 described above. Since it is sufficient if only one of the support elements in a pair of support elements has a tensioning function, however, the opposite support element may be simplified. The opposite support element may, for instance, comprise an element in the form of the clamping profile described above which element, however, is rigidly fixed to the base.

In the initial stage of tensioning the angle between frame and clamping profiles 7, 8 is relatively large and decreases during the tensioning process. This angle may be measured, for instance, between the mid-sections 14, 29 of the frame and clamping profiles 7, 8, as shown in FIG. 2 where the angle is designated α. Initially the tension in the fabric 3 increases as the angle α decreases and the tension in the fabric acts to turn the clamping profile 7 back, i.e. counter-clockwise, out of the clamping pocket 25. An equilibrium exists, however, at a predetermined angle at which the tensile stress in the fabric 3 is unable to turn the clamping profile 7 back. When this equilibrium is exceeded the tensile stress instead acts to force the clamping profile 8 into a locked position in the clamping pocket 25. The tensile stress in the fabric 3 is greatest at equilibrium and decreases somewhat when equilibrium has been exceeded. During assembly the clamping profile 8 is pressed manually past this equilibrium, whereupon the tensile stress in the fabric 3 brings the external surfaces 41 and 43 of the clamping profile 8 into contact with the internal surfaces 23 and 24, respectively, of the frame profile 7 as shown in FIG. 3 so that a self-locking engagement between the frame and clamping profiles 7, 8 is formed. Due to the tensile stress in the fabric 3 it is very difficult in this final position to move the clamping profile 8 out of the clamping pocket 25 manually, i.e. without any tools, and this position should therefore be considered a locked position and is maintained by the tensile stress in the fabric 3. The support element 1 should therefore be considered to be self-locking since no additional locking means besides the frame and clamping profiles 7, 8 described above is required to lockably assemble the fabric 3 on the support element 1. A suitable tool must be used for dismantling the fabric 3 in order to move the clamping profile 8 past said equilibrium and out of the clamping pocket 25. An alternative dismantling method is to cut the fabric 3 so that the locking tensile stress in the fabric 3 disappears, after which the clamping profile 8 can easily be removed from the clamping pocket 25 and the bar 49 with the edge portion 4 of the fabric wound around it can be removed from the assembly pocket 48. With the latter procedure, however, the fabric 3 cannot be removed in one piece.

The angle at which equilibrium occurs can generally be stated to depend, inter alia, on the geometry of the frame and clamping profiles 7, 8, where the fabric 3 is anchored in the clamping profile 8 and the direction in which the tensile stress acts. However, it will be understood that for the function of the invention it is important that the outer flange-like wall section 19 has a predetermined minimum extension, seen in the cross section of the frame profile 7, so that the clamping pocket 25 has a depth that allows said equilibrium to be achieved. In the embodiment shown in FIG. 2 the depth of the clamping pocket 25 is approximately 7 mm and the distance in the normal direction of the wall section 17 between the inner wall section 17 and the free support end 20 is approximately 6 mm. Consequently, in the present case the ratio between the depth of the clamping pocket 25 and the height of its opening is around 1:1. In the embodiment of the invention shown in FIG. 2 said ratio shall preferably exceed 1:2.

Although the support element 1 is self-locking in certain special applications it is preferable to secure the locking by applying external locking members in case the locking tension in the fabric 3 should be lost for some reason, such as the fabric 3 rupturing. Such an application is fabric signs on vehicles where external locking members, e.g. in the form of said locking profile 10 firmly screwed into place are preferably applied.

Figure 2:
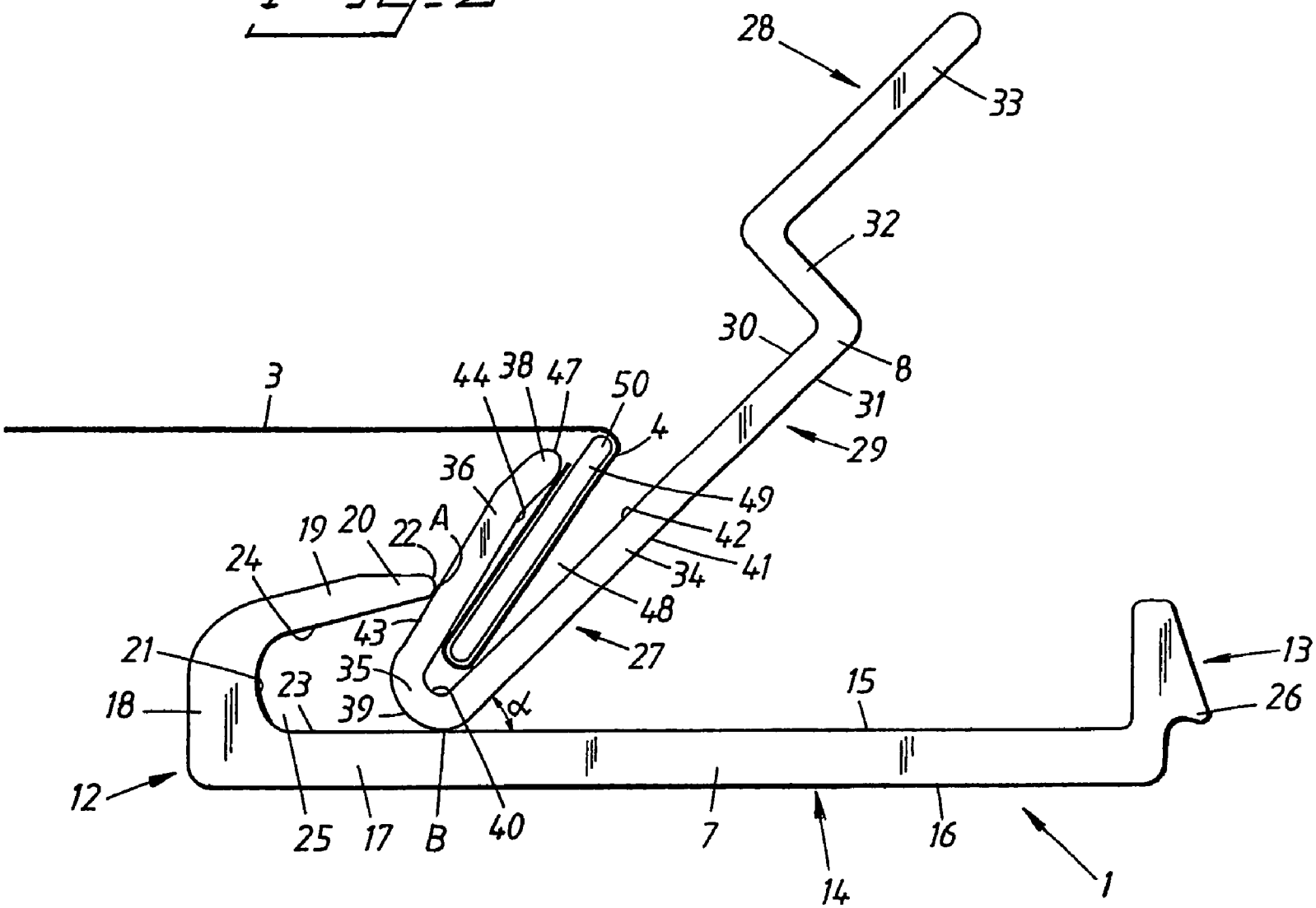
FIG. 2 is an end view of a cut out part of a fabric sign in accordance with FIG. 1 during assembly of the fabric.
Figure 3:
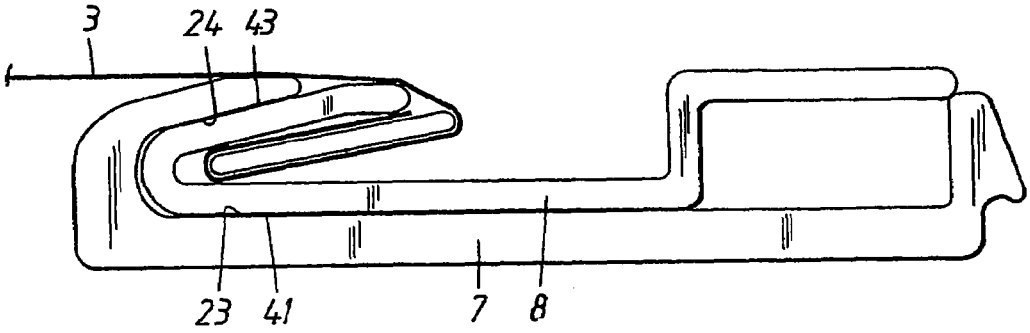
FIG. 3 is an end view of a cut out part of a fabric sign in accordance with FIG. 1 in which the fabric is in a stretched and locked position.
Figure 4:
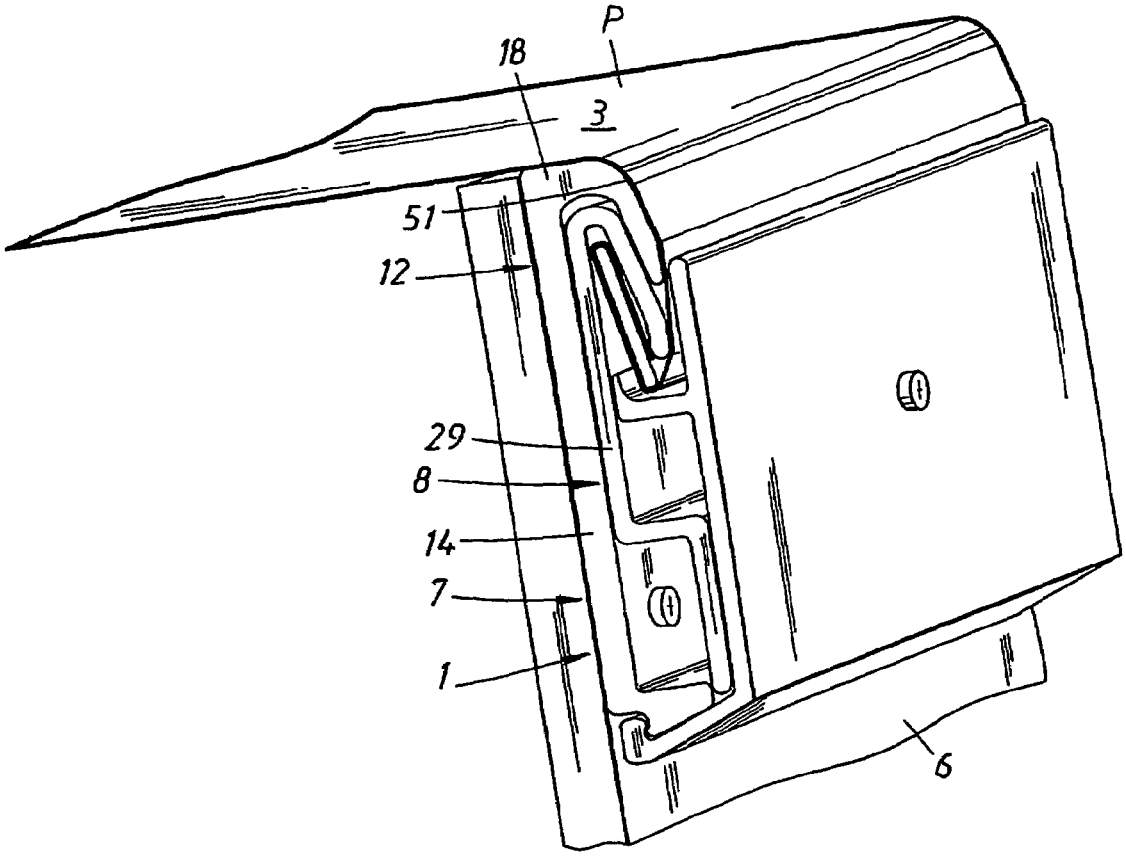
FIG. 4 is a perspective view of a cut out part of a fabric sign in accordance with a second embodiment of the invention.

In the embodiment illustrated in FIGS. 1–3 the mid-sections 14, 29 of the frame and clamping profiles 7, 8 extend in a direction parallel to the plane P of the fabric, seen in the final position of the frame and clamping profiles 7, 8, i.e. when the clamping profile 8 is in locked position. With such substantially parallel alignment the height of the fabric sign is slight and such alignment is therefore particularly preferred for fabric signs on container walls and the sides of trucks. FIG. 4 shows an alternative embodiment of a fabric sign in accordance with the invention, in which the plane P of the fabric 3 is substantially perpendicular to the mid-sections 14, 29 of the frame and clamping profiles 7, 8, seen in the final positions of the frame and clamping profiles 7, 8. In this case the fabric sign comprises a stand 6 on which the support element 1 is secured, and the fabric 3 runs over a convex surface 51 of the end wall section 18 of the inner edge part 12 of the frame profile 8. At its other end, not shown, the fabric 3 is attached to an opposing support element, not shown, which is identical to the support element 1 shown. Since the height of the fabric sign can be adjusted by making the stand 6 deeper, such a fabric sign is preferable if some form of light source shall be placed behind the fabric. In general the support elements can be arranged so that the mid-sections 14, 29 of the frame and clamping profiles 7, 8 which are parallel with each other in the locked position, form an angle with the plane P that lies within the interval 0–360 degrees.

The fabric sign in accordance with the invention enables simple, reliable and self-locking tensioning of the fabric. Furthermore, the construction of the fabric sign is simple, thereby entailing low manufacturing costs and making it possible for untrained people, such as drivers on whose truck the fabric sign is to be mounted, to quickly change the fabric in the sign. The invention has been described above with reference to two embodiments. However, it should be understood that other embodiments are feasible within the scope of the invention. The frame and clamping profiles, for instance, may be shaped differently from the manner described above while still retaining the self-locking function. Furthermore, the fabric may be anchored to the clamping profile in other ways than that described above without departing from the principle of the invention.

The invention claimed is:

1. A fabric sign comprising at least one pair of parallel support elements for attachment to a base and a fabric comprising two parallel edge portions for assembly on one each of the support elements, at least one of the support elements comprising:

a frame profile that includes, an attachment part for said attachment to the base, and a counter support part that includes an inner wall section forming a continuation of said attachment part, an outer, flange-like wall section with a free supporting end to form a pivot (A), and an end wall section connecting the inner and outer wall sections, said wall sections defining between them a clamping pocket, and a clamping profile for clamping the fabric to the frame profile, which clamping profile comprises a pressure part for manual actuation, retaining devices for retaining the edge portion of the fabric, and an engagement part arranged to cooperate with the inner and outer wall sections of the counter support when the pressure part is pressed against the attachment part while the clamping profile is turned about said pivot (A), at the same time creating tensile stress in the fabric, characterized in that the outer wall section of the counter support has a predetermined minimum extension, seen in a cross section of the frame profile, that allows the clamping profile to exceed an equilibrium defined by a predetermined angle a between the frame and clamping profiles, at which exceeding of the equilibrium the tensile stress acts to move the clamping profile to a locked position in which the clamping profile is in locked engagement with the frame profile, said locked position being maintained by the tensile stress.

2. A fabric sign as claimed in claim 1, characterized in that the clamping profile comprises an inner edge part, an outer edge part and a mid-section that joins the edge parts together, the inner edge part forming said engagement part and comprising an inner wall section connected to the mid-section and having an external surface, a bent end wall section connected to the inner wall section, and an outer wall section substantially parallel to the inner wall section and connected to the end wall section and having an external surface, where the external surfaces of the inner and outer wall sections of the engagement part are arranged to cooperate with internal surfaces of the inner and outer wall sections of said counter support part in said locked position.

3. A fabric sign as claimed in claim 2, characterized in that said internal and external surfaces are flat.

4. A fabric sign as claimed in claim 2, characterized in that the end wall section of the counter support part has an internal surface forming the bottom of the clamping pocket, and in that the internal surfaces of the inner and outer wall sections of the counter support part converge in the direction of said bottom.

5. A fabric sign as claimed in claim 2, characterized in that the support end of the counter support part is provided with a supporting surface which, when the fabric is assembled, is arranged to cooperate with the external surface of the outer wall section of the engagement part along a first contact line (A) that forms said pivot.

6. A fabric sign as claimed in claim 2, characterized in that the end wall section of the engagement part has an external end surface which, when the fabric is assembled, is arranged to cooperate with the internal surface of the inner wall section of the counter support part along a second contact line (B).

7. A fabric sign as claimed in claim 6, characterized in that during assembly of the fabric, the first contact line (A) is arranged to move along the external surface of the outer wall section of the engagement part, and along the support surface of the support end of the counter support part, at the same time as the second contact line (B) is arranged to move along the end surface of the end wall section of the engagement part, and along the internal surface of the inner wall section of the counter support part.

8. A fabric sign as claimed in claim 1, characterized in that the ratio between the depth and opening height of the clamping pocket exceeds 1:2.

9. A fabric sign as claimed in claim 2, characterized in that the attachment part of the frame profile and the mid-section of the clamping profile are parallel to each other in said locked position and form an angle with the plane (P) of the fabric that lies within the interval 0–360 degrees.

10. A fabric sign as claimed in claim 9, characterized in that said angle is 0 degrees.

11. A fabric sign as claimed in claim 2, characterized in that the inner and outer wall sections and the end wall section of the engagement part have internal surfaces defining an assembly pocket and that said retaining devices comprise the assembly pocket and a bar around which the edge portion of the fabric is folded, said bar with the edge portion of fabric wound around it is arranged to be inserted into the assembly pocket during assembly, and clamp the edge portion of the fabric between itself and the internal surfaces of the inner and outer wall sections of the engagement part.

* * * * *

UNITED STATES PATENT AND TRADEMARK OFFICE

CERTIFICATE OF CORRECTION

PATENT NO. : 7,178,281 B2
APPLICATION NO. : 10/491617
DATED : February 20, 2007
INVENTOR(S) : Johansson et al.

It is certified that error appears in the above-identified patent and that said Letters Patent is hereby corrected as shown below:

Column 1, line 5, after "United States", insert a period --.--;

Column 1, line 6, delete "Sweedish" and insert therefor --Swedish--.

Column 7, line 19, claim 1, delete "angle a" and insert therefor --angle α--.

Signed and Sealed this

Fifteenth Day of January, 2008

JON W. DUDAS
*Director of the United States Patent and Trademark Office*